US006215396B1

(12) United States Patent
Script

(10) Patent No.: US 6,215,396 B1
(45) Date of Patent: Apr. 10, 2001

(54) PORTABLE MOTION DETECTOR AND ALARM SYSTEM AND METHOD

(76) Inventor: Henry J. Script, 887 W. Ferry St., Buffalo, NY (US) 14209

( * ) Notice: Subject to any disclaimer, the term of this patent is extended or adjusted under 35 U.S.C. 154(b) by 0 days.

(21) Appl. No.: 09/271,511

(22) Filed: Mar. 18, 1999

Related U.S. Application Data

(63) Continuation-in-part of application No. 08/865,886, filed on May 30, 1997, now abandoned.
(60) Provisional application No. 60/018,829, filed on May 30, 1996.

(51) Int. Cl.[7] ..... G08B 13/08
(52) U.S. Cl. ..... 340/545.1; 340/546; 340/547; 340/548; 340/539
(58) Field of Search ..... 340/545.1, 546, 340/547, 548, 549, 539

(56) References Cited

U.S. PATENT DOCUMENTS

| | | | |
|---|---|---|---|
| 3,696,359 | 10/1972 | Ross et al. | 340/547 X |
| 3,696,380 | 10/1972 | Murphy | 340/546 |
| 3,781,836 | 12/1973 | Kruper et al. | 340/539 |
| 3,833,895 | 9/1974 | Fecteau | 340/545.1 X |
| 4,148,019 | 4/1979 | Durkee | 340/545.1 X |
| 4,149,156 | 4/1979 | Blasucci | 340/545.2 |
| 4,271,405 | 6/1981 | Kitterman | 340/512 |
| 4,888,580 | 12/1989 | Distel | 340/573.1 |
| 5,317,303 | 5/1994 | Ross et al. | 340/539 |
| 5,489,890 | 2/1996 | Moser | 340/546 |

*Primary Examiner*—Thomas Mullen
(74) *Attorney, Agent, or Firm*—Joseph P. Gastel

(57) ABSTRACT

A portable security alarm system which can be installed on a temporary basis and removed from an object whose movement is to be detected including a motion detecting and radio signal transmitting member for mounting proximate the object whose movement is to be detected, a member for selectively coupling and decoupling the motion detecting and radio signal transmitting member relative to the object whose movement is to be detected, a combined radio signal receiving and alarm generating member for receiving a signal from the combined motion detecting and radio signal transmitting member and producing an alarm, and a remote control for actuating and deactuating the radio signal receiving and alarm generating member.

26 Claims, 4 Drawing Sheets

PORTABLE MOTION DETECTOR AND ALARM SYSTEM AND METHOD

CROSS-REFERENCE TO RELATED APPLICATIONS

This application is based on provisional application number 60/018,829, filed May 30, 19996 in the name of the same inventor, and it is a continuation-in-part of application Ser. No. 08/865,886, filed May 30, 1997, abandoned.

STATEMENT REGARDING FEDERALLY SPONSORED RESEARCH OR DEVELOPMENT

Not Applicable

BACKGROUND OF THE INVENTION

1. Field of the Invention

The invention relates generally to an improved motion detector and alarm system for actuating an alarm device in response to movement of an object, and more particularly to a portable motion detector and alarm system which is easy to install and operate and is capable of detecting motion relative to a variety of predetermined positions.

2. Prior Art

The problem of protecting homes, businesses and other premises against unauthorized intrusions is becoming increasingly important due to the increase in vandalism, theft and even physical attacks upon the inhabitants. Various prior art systems have been developed to address the problem and numerous examples exist of alarm or warning devices. One commonly used protective system involves wiring doors and windows in such a manner that an unauthorized opening of the door or window activates an electric circuit which in turn produces an alarm.

For example, U.S. Pat. No. 4,271,405 to Kitterman discloses an alarm control system for protecting a premises including a four conductor bus line leading from a master control station and extending about the interior perimeter of the premises. Sensors positioned near each port of entry to be monitored are connected in parallel relationship to the bus line. Each sensor carries a biased reel carrying line secured to a window, door, screen or the like. Disturbance of a sensor causes a magnetically responsive switch therein to generate a pulse triggering circuitry within the control station to activate the desired alarm device.

While effective, this system requires extensive wiring of the premises as a bus line must be routed about the interior perimeter of the premises between a master control station and the ports of entry at which the motion sensors are to be located. Hence, this system is time consuming and complicated to install, and installation may require expertise beyond that of the average home or business owner. Once installed, the sensors of this system are not easily relocated. Further, the system may be defeated by cutting the wires extending between the sensors and the master control station.

U.S. Pat. No. 3,781,836 to Kruper et al discloses an alarm system including a magnetic pulse generator for producing an output pulse in response to a change in magnetic flux in response to an intrusion of a designated area. A radio transmitter circuit responds to the pulse from the magnetic pulse generator by transmitting a signal to a remote receiver circuit which in turn generates a pulse for actuating an intrusion alarm circuit. The system requires a complex linkage assembly to translate motion of the object to motion of a magnet. In addition a relatively bulky pick-up coil assembly is necessary to generate the pulse to be applied to the transmitter circuit.

U.S. Pat. No. 3,696,380 to Murphy discloses a portable alarm device with a battery or low voltage operated sound signal triggered by a magnetic reed switch which is closed to complete the circuit by a magnet attached to a movably mounted arm, the poles of the magnet being positioned perpendicular to the longitudinal dimension of the contact strips of the reed switch to cause the reed switch to close when the magnet is in either of two positions relative to the switch.

A need remains for a motion detection and signal generating system which is small in size, easily transportable, easy to install and which can sense motion relative to any desired initial position of an object.

BRIEF SUMMARY OF THE INVENTION

Accordingly, it is a principal object of the invention to provide a system for detecting the movement of an object comprising: an object whose movement is to be detected, movable magnet means coupled to the object such that movement of the object results in movement of said movable magnet means, and means for detecting movement of the movable magnet means and providing an indication of the movement. The means for detecting is in communication with the movable magnet means.

The system further includes radiating means for wirelessly transmitting a predetermined signal in response to the indication of movement, the radiating means being coupled to the means for detecting. The object whose movement is to be detected may be coupled to the movable magnet means by a wire means which can also serve as the radiating means.

The system further includes means for receiving the predetermined signal, the means for receiving being separate from and located at a distance from the radiating means. The system preferably includes means for generating an alarm signal when the predetermined signal is received by the means for receiving. The alarm signal thus generated may be audible, visual or electronic and may include speakers, warning horns, lamps 30' and the like.

It is a further object of the invention to provide a method of detecting movement of one or more objects comprising the steps of: a) coupling each object whose movement is to be detected to a corresponding movable magnet such that movement of any object results in movement of the corresponding magnet; b) detecting the motion of the corresponding magnet; c) transmitting a predetermined signal in response to the detected motion, and, d) receiving the predetermined signal at a distance from the object, or objects, whose motion is to be detected.

The method may include the further step of providing an alarm signal when the predetermined signal is received by the receiver means. The alarm signal may be audible, visible, or may be an electronic alarm signal which is transmitted to a remote alarm center via a telecommunications means such as a telephone line.

It is a further object of the invention to provide a movement detection and alarm system which may be affixed to a wide variety of objects including inside doors, outside gates, garage doors, children's barriers such as "baby gates", valuable wall hangings and paintings, and countless other objects.

It is a further object of the invention to provide a movement detection and alarm system which is portable and is easily packed in a suitcase and transported with a traveler to be later installed on motel or hotel room doors and windows whenever additional protection is desired by the traveler.

The present invention relates to a portable security alarm system which can be installed on a temporary basis and removed from an object whose movement is to be detected comprising a motion detecting and radio signal transmitting member, means for selectively coupling and decoupling said motion detecting and radio signal transmitting member relative to said object whose movement is to be detected, and a combined radio signal receiving and alarm generating member for receiving a signal from said combined motion detecting and radio signal transmitting member and producing an alarm. The alarm system also preferably includes a remote control member for selectively actuating and deactuating said combined radio signal receiving and alarm generating member.

BRIEF DESCRIPTION OF THE SEVERAL VIEWS OF THE DRAWING

The foregoing and other objects and features of the present invention will become more fully apparent from the following description and appended claims, taken in conjunction with the accompanying drawings. Understanding that these drawings depict only typical embodiments of the invention and are, therefore not to be considered limiting of its scope, the invention will be described with additional specificity and detail through use of the accompanying drawings in which:

DETAILED DESCRIPTION OF THE INVENTION

The following detailed description of the embodiments of the present invention, as represented in FIGS. 1–10, is not intended to limit the scope of the invention, as claimed, but is merely representative of the presently preferred embodiments of the invention. The presently preferred embodiments of the invention will be best understood by reference to the drawings, wherein like parts are designated by like numerals throughout.

Figure 1:
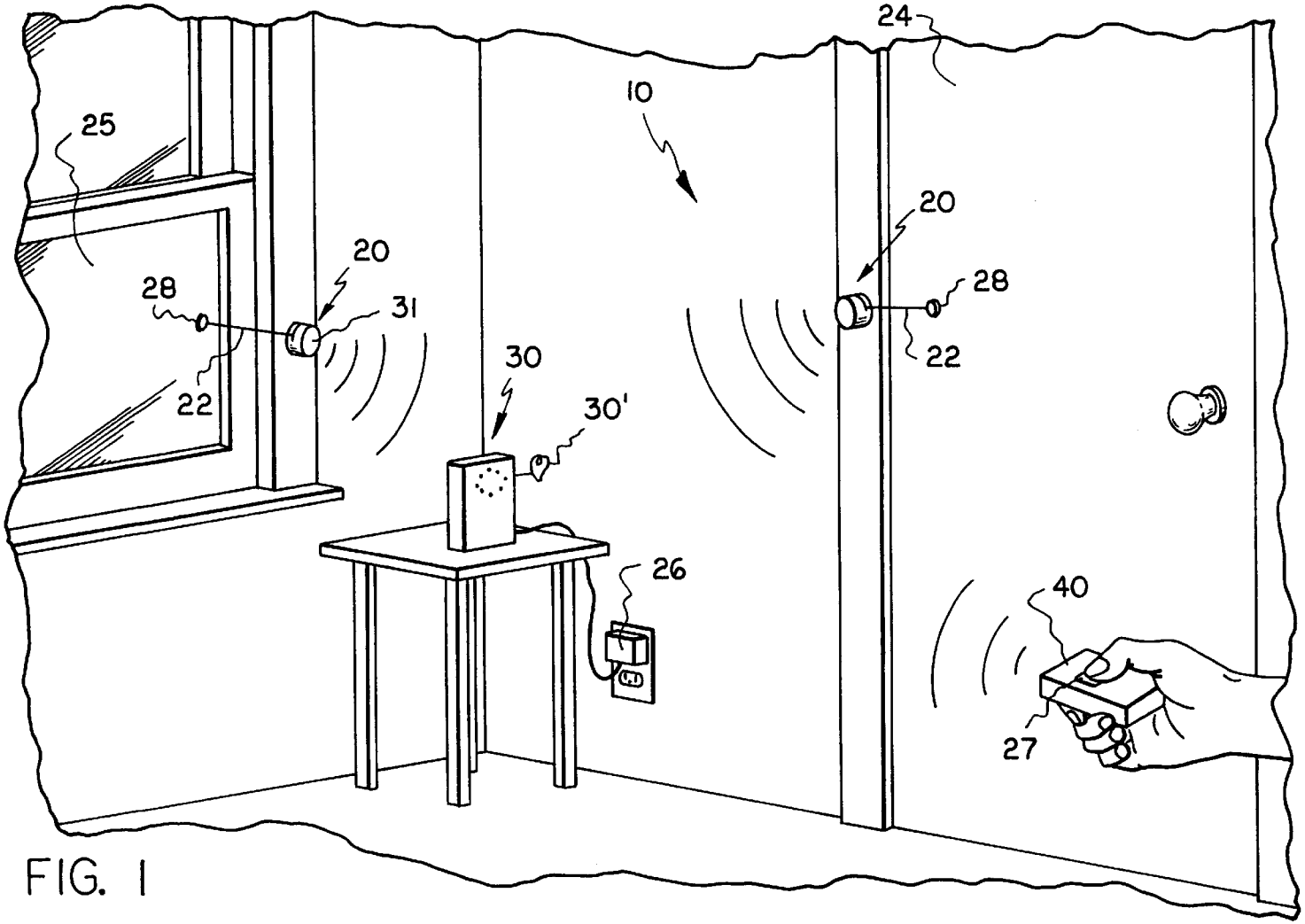
FIG. 1 is a pictorial diagram showing the components of the system according to the present invention as they appear in use.

FIG. 1 shows, in pictorial block diagram form, the major components of the movement detecting device and alarm system 10 of the present invention. The system is comprised of at least one movement detecting and signal transmitting means 20, including a retractable wire means 22, a receiver means 30 and a remote control means 40.

More than one movement detecting and signal transmitting means 20 may be utilized in implementing the system of the present invention. One movement detecting and signal transmitting means 20 may be placed on each object whose movement it is desired to detect. For example, in a room with four windows 25 and two doors 24, six movement detecting and signal transmitting means 20 may be utilized, one on each window and one on each door. However, only one receiver means 30 is necessary regardless of the number of movement detecting and signal transmitting means 20 used. There is no limit to the number of movement detecting and signal transmitting means 20 which may be used with one receiver.

Each movement detecting and signal transmitting means 20 is coupled to one object, such as a door 24, or window 25, whose movement is to be detected. In a preferred embodiment, the coupling means is a retractable wire 22 which extends from movement detecting and signal transmitting means 20 to the object, 25 or 24, whose movement is to be detected. One end of retractable wire 22 is affixed to the object and the other is coupled to movable magnets (best illustrated in FIGS. 4, 5 and 6) located inside casing 31 of movement detecting and signal transmitting means 20. Typical means of affixing the end of retractable wire 22 to an object include VELCRO tabs, glue, removable tape, and the like.

Receiver means 30 is configured to receive a predetermined signal which is wirelessly transmitted by movement detecting and signal transmitting means 20 whenever the object whose movement is to be detected, is displaced from a predetermined position. The object whose movement is to be detected need not be in any particular position when the end of retractable wire 22 is affixed thereto. If the object is a window, such as depicted at 25, the window may be closed, or it may be partially or fully open, when retractable wire 22 is affixed. Any displacement from its position when retractable wire 22 is affixed will be detected and alarmed.

Accordingly, a window may be left in a partially open position, as for example, to provide fresh air to a room, while the occupant attends to other matters, or sleeps. Any displacement from the partially open position will cause the alarm signal to be generated. Even in a situation wherein an intruder reached into the window and removed movement detecting and signal transmitting means 20 from the window, the predetermined signal would be transmitted and the alarm signal generated, thus warning the occupant of an intrusion.

Receiver 30 can be any receiver known in the art capable of receiving the signal transmitted through retractable wire 22. In response to the transmitted signal, receiver 30 initiates a local alarm which can be audible or visual. In addition, receiver 30 may initiate contact with police, medical, rescue or other emergency facilities or agencies. Receiver 30 can be AC powered and may be equipped with an on/off switch. Receiver 30 need not be co-located with movement detection and signal transmitting means 20 and can be positioned anywhere within reception distance of the transmitted signal. Receiver means 30 may be positioned anywhere about the room or the area to be protected and may be placed up to a distance of 150 ft. to 200 ft. or greater from movement detecting and signal transmitting means 20.

In a preferred embodiment receiver means 30 is powered by alternating current (AC). Therefore, it must be located such that a power cord, or an extension thereof, can be extended to the nearest AC outlet. Alternate embodiments of receiver means 30 may be powered by battery, or may include battery backup means to supply power to receiver 30 in the event of a power failure.

Figure 10:
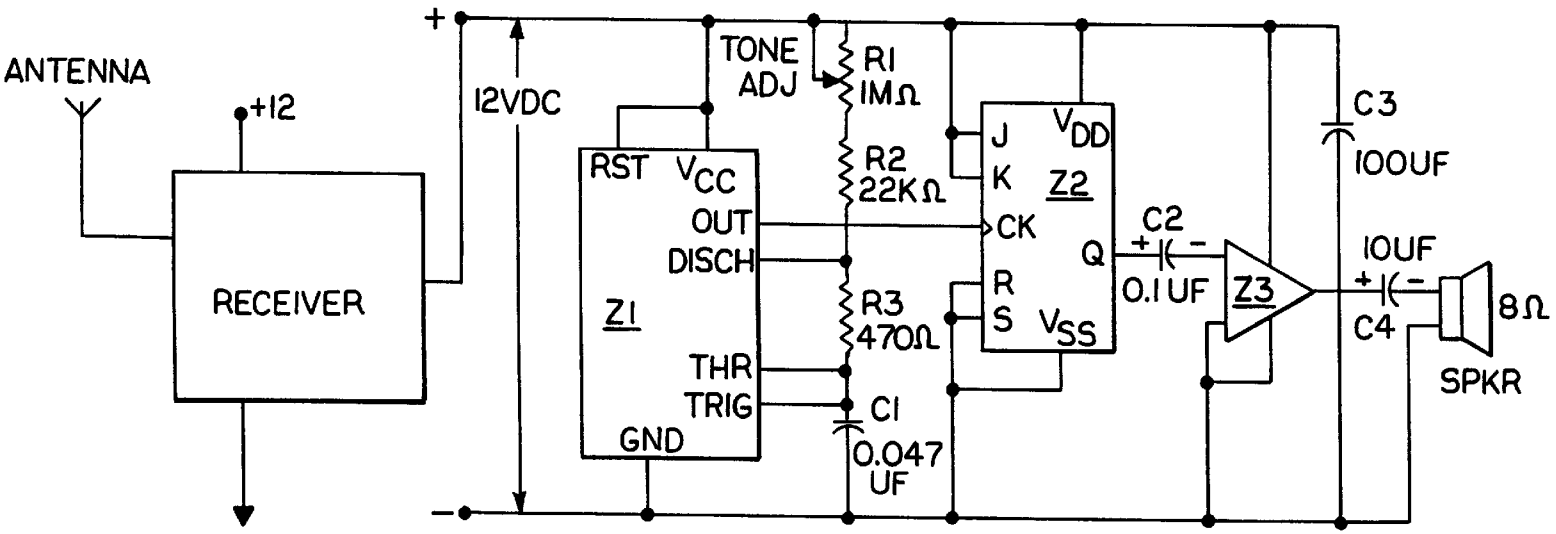
FIG. 10 is a schematic diagram of one embodiment of a receiver means according to the present invention.

In a preferred embodiment receiver means 30 is a commercially available BLACK WIDOW receiver unit, or similar units, which may be purchased off-the-shelf from various electronics supply companies such as Whitney Electronics or Holsfelt Electronics. An AC adapter such as that depicted at 26 in FIG. 1 may be used to provide the correct operating voltage for receiver means 30. In a preferred embodiment of the present invention a BLACK WIDOW RF receiver Model #2.CL manufactured by LCD Co. of California was used as a receiver. FIG. 10 shows a schematic diagram, of a type well understood by those of ordinary skill in the electronics arts, of a receiver unit suitable for use in the present invention.

Returning to FIG. 1, the system of the present invention may also include a remote control unit 40 which may be purchased from the same source as receiver means 30. Remote control means 40 controls the operating state of receiver means 30. That is, remote control means 40 may be used to electronically enable or disable receiver means 30 such that the response of receiver 30 to the signal transmitted by retractable wire 22 can be controlled. Remote control means 40 preferably includes a panic button which, when depressed or otherwise enabled, transmits a signal which instantly activates the alarm function of receiver means 30. The means for activating can be a switch 27 which may be operated by hand to cause remote control unit 40 to activate the alarm signal, or to discontinue the alarm signal after it has been activated by either the predetermined signal or the remote control unit 40 itself.

This feature serves as a "panic" button, i.e., a means of triggering the alarm within receiver 30 to attract attention or call for aid in the presence of other emergencies. When it is desired to discontinue the alarm signal, switch 27 may be set to a position which causes the previously activated alarm signal to stop. Such remote control units and receivers are well known in the electronic arts and are commonly used in other electronics applications. Accordingly, remote control unit 40 is also readily available from commercial sources and may be purchased and utilized in the system of the present invention "off-the-shelf."0 The transmitter circuit of remote control unit 40 may be used as a model for transmitter 4 (FIG. 9) of the movement detector and signal transmitting means 20 of the present invention such that both transmit the proper signal for receiver means 30.

This feature may also serve as a means of testing the system 10 to determine its operational status, i.e., ready to operate (or armed), or malfunctioning. If switch 27 is manually set by the operator to a position designed to activate the alarm signal within receiver 30, and no alarm signal is produced, a malfunction condition is present. If the alarm signal within receiver 30 is produced, the system 10 may be considered "armed" or ready to operate.

Once system 10 is configured as desired, i.e., each movement detecting and signal transmitting means 20 is positioned on a corresponding object whose motion is to be detected, and receiver 30 is armed, any movement of window 25 or door 24 will cause a predetermined signal to be radiated from movement detecting and signal transmitting means 20 and wirelessly transmitted to receiver 30. Receiver 30 will receive the transmitted predetermined signal and provide an alarm signal in response. In the embodiment shown the alarm signal is an audio signal provided through one or more speakers located within receiver 30.

Figure 2:
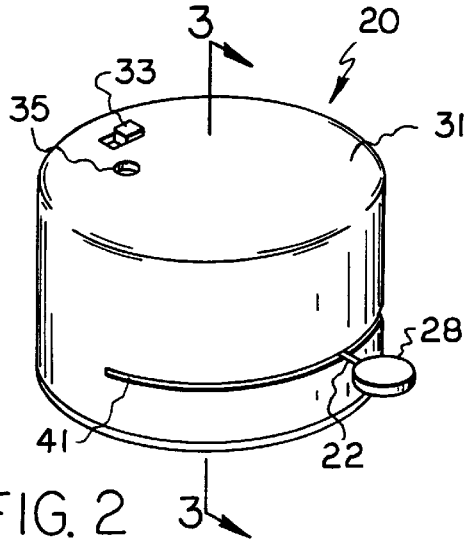
FIG. 2 is a perspective view of the motion sensing and transmitting means of the present invention.

Turning now to FIG. 2 there is shown a perspective view of movement detecting and signal transmitting means 20, including casing 31, switch 33, retractable wire affixing means 28 and retractable wire 22. Casing 31 may include an opening 35 for allowing visible light, as from a lamp or an LED 32, to be seen by the naked eye. The illumination of such a lamp, or light emitting means, gives an operator a visible indication of the operational status of movement detecting and signal transmitting means 20.

Casing 32 further includes a slotted opening 41 through which retractable wire 22 and retractable wire affixing means 28 may be disposed. This allows flexibility in positioning retractable wire 22 on an object relative to the position of movement detecting and signal transmitting means 20.

Figure 3:
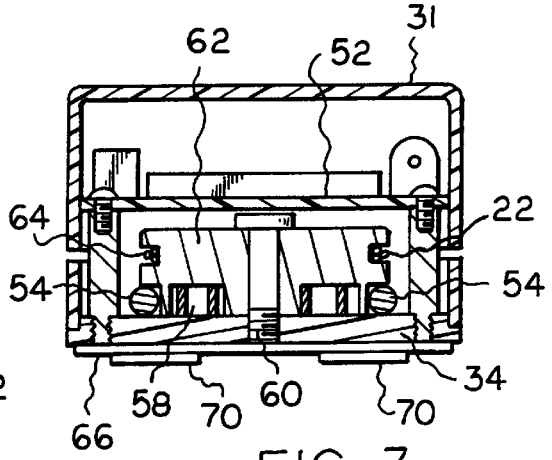
FIG. 3 is a cross sectional view of the motion sensing and transmitting means of the present invention taken along lines 3—3 of FIG. 2.

FIG. 3 shows a cross sectional view of the movement detecting and signal transmitting means depicted in FIG. 2, taken along lines 3—3 of FIG. 2. Casing 31 surrounds the internal components. The major internal components of movement detecting and signal transmitting means 20 are: an electronic circuit board 52, a rotatable frame 62 for supporting magnet means 54, a supporting base means 34 and a rear panel 66. Rotatable frame 62 includes a channel means 64, wherein retractable wire means 22 may be disposed, and wrapped around rotatable frame 62. Also shown is spring means 58 (best illustrated in FIG. 8) for maintaining constant tension on wire means 22 as wire means 22 is pulled closer, or further from casing 31. The foregoing components are coupled together by pin means 60 (best illustrated in FIGS. 7 and 8).

Figure 4:
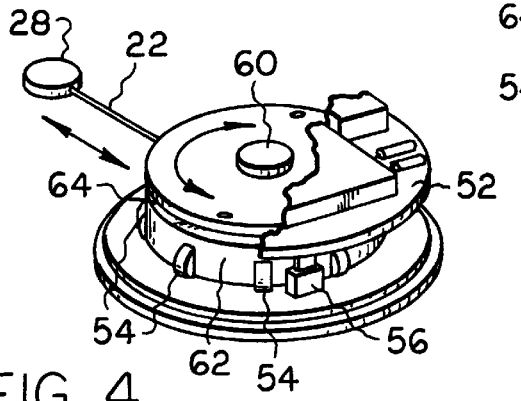
FIG. 4 is a perspective view of the interior of the motion sensing and transmitting means of the present invention.

As shown in FIG. 4 retractable wire means 22 is in communication at one end with rotatable frame 62. Rotatable frame 62 includes one or more movable magnets 54, preferably opposite pole magnets which are spaced from each other and disposed within rotatable frame 62. The preferred embodiment includes 8 such magnet means 54 spaced equidistantly from each other around rotatable frame 62. Magnet means 54 may be of a type commonly available commercially from sources such as Radio Shack. One such magnet means suitable for use in a preferred embodiment of the present invention is a common ⅛" diameter earth magnet available from Radio Shack, part number 64-1895.

Rotatable frame 62 is preferably a circular supporting frame which is provided with a central opening 70 about which rotatable frame 62 rotates. Rotatable frame 62 is adapted to include a channel 64 for receiving retractable wire 22. Channel 64 extends about the circumference of rotatable frame 62 and allows retractable wire 22 to be wrapped about rotatable frame 62 in a manner similar to that of a string wrapped around a yo yo. The end of retractable wire 22 is in contact with rotatable frame 62 may be affixed to rotatable frame 62 by traditional means such by knotting the end of retractable wire 22 and inserting it into a notch within channel 64, or by wrapping and tying one end of retractable wire 22 securely around channel 64. Retractable wire 22 must be secured such that slippage of retractable wire 22 within channel 64 is avoided. Other means of securing one end of retractable wire 22 within channel 64 will be readily apparent to those skilled in the art.

Magnet means 54 may be inserted into openings (not shown) in rotatable frame 62 and held in place by means of glue, or other suitable affixing means. The openings into which magnet means 54 are inserted should provide a snug fit for magnet means 54 such that movable magnet means 54 will remain securely in place throughout the life of system 10.

Figure 7:
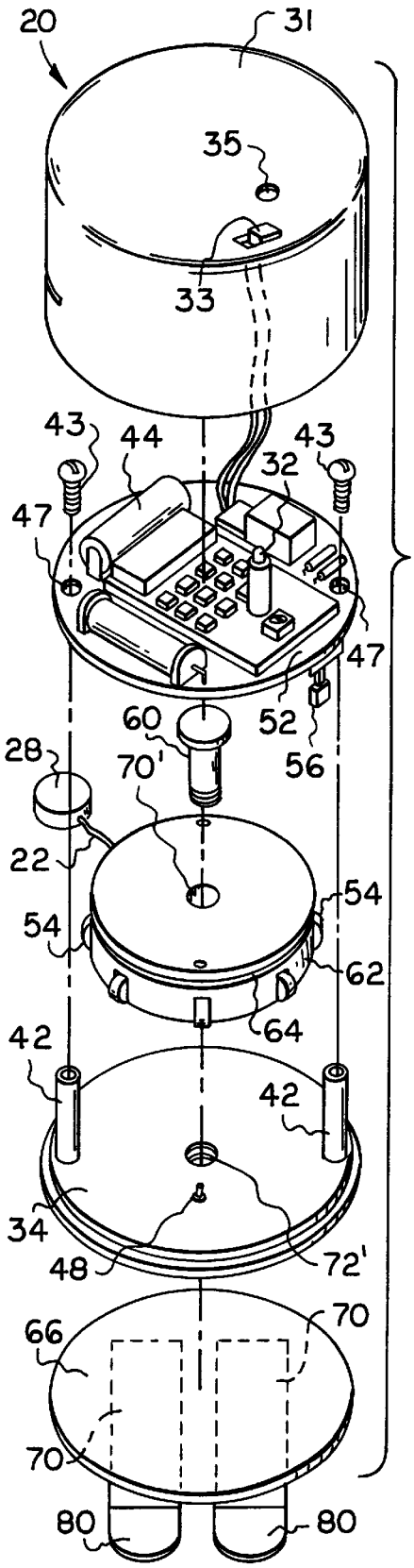
FIG. 7 is an exploded top perspective view of the motion sensing and transmitting means of the present invention.
Figure 8:
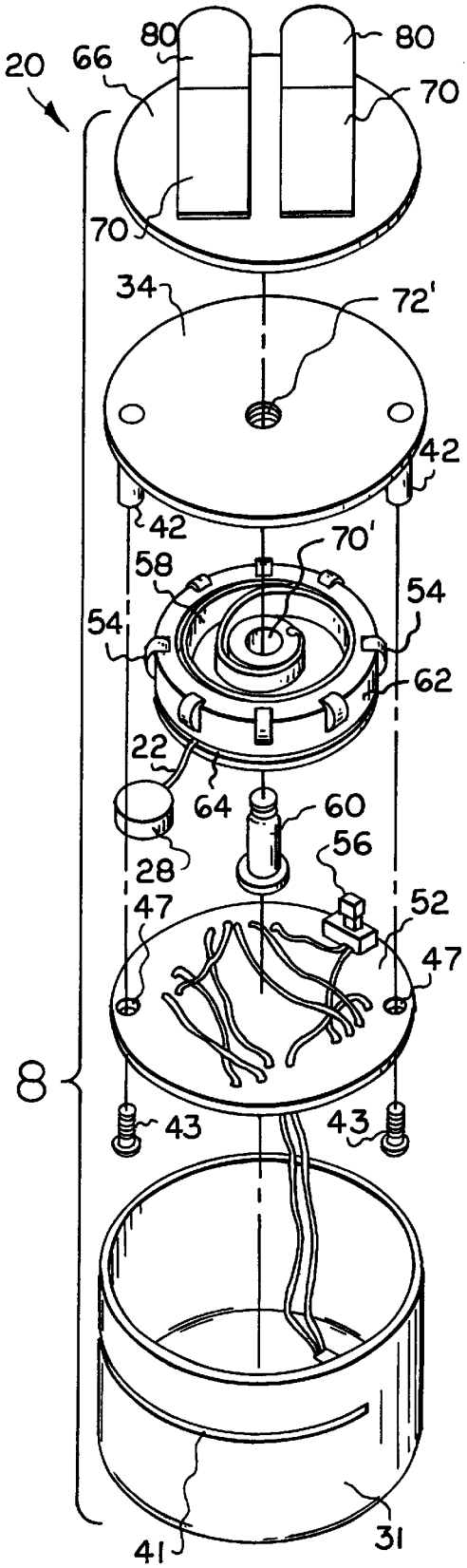
FIG. 8 is an exploded bottom perspective view of the motion sensing and transmitting means of the present invention.

FIGS. 7 and 8 show exploded views from the top and bottom, respectively, of movement detecting and signal transmitting means 20. As shown in the figures, case 31 and rear panel 66 enclose the components of movement detecting and signal transmitting means 20. On/off switch 33 provides a means for connecting and disconnecting power from battery 44 from the components residing on electronic circuit board 52. Battery 44 may be a common 9V battery of a size suitable for disposition within case 31. Other battery means, such as miniature batteries, may be utilized to construct smaller embodiments of the present invention. Such means will be readily apparent to those skilled in the art.

Electronic circuit board 52 includes means 56 for detecting movement of movable magnet means 54. Means 56 for detecting movement of movable magnet means 54 may be a magnetic field sensor such as a KMZ10B available from Phillips Semiconductors. A schematic diagram of a type readily understood by those skilled in the electronics arts illustrating a preferred circuit connection for means 56 for detecting movement, is provided in FIG. 9.

The circuit depicted in FIG. 9 operates generally as follows. When the object whose movement is to be detected moves in any direction, retractable wire 22 either extends or retracts (as best depicted in FIG. 1). When the object moves toward movement detecting and signal transmitting means 20, retractable wire 22 recoils toward movement detecting and signal transmitting means 20, and vice versa.

Figure 6:
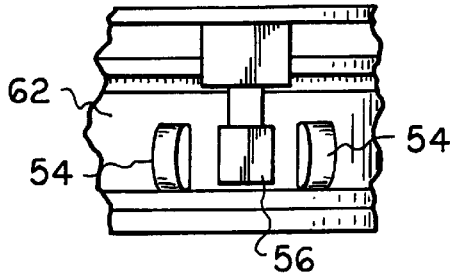
FIG. 6 is a close-up view of the movable magnet means.
Figure 5:
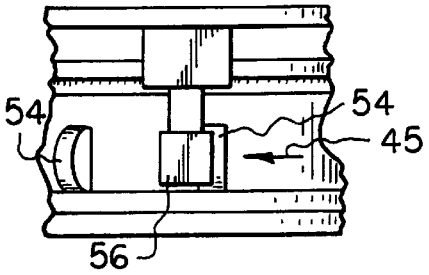
FIG. 5 is a close-up view of the sensing means.

As retractable wire 22 moves, movable magnets 54 rotate. When movable magnet means 54 are displaced from their resting position, a change in the magnetic field surrounding movable magnet means 54, with respect to magnetic field sensor 56 occurs. FIG. 6 shows two rotatable magnet means 54 in one possible resting position with respect to magnetic field sensor 56. FIG. 5 shows movable magnet means 54 as they move in direction 45, as shown by the arrow, past magnetic field sensor 56. It is the change of the position of movable magnets relative to magnetic field sensor 56 which is detected by magnetic field sensor 56.

Returning to FIG. 9, magnetic field sensor 56 senses the change in the magnetic field and provides a signal representing the change, to comparator 1, in this case a common LM 741. The output of comparator 1 causes relay 2 to energize closing contact 3 and enabling battery power to operate radiating means, i.e., transmitter 4. The circuitry of transmitter 4 can be any available transmitter configuration known in the art which is capable of transmitting a signal through retractable wire 22 and which can be configured to fit on transmitter circuit board 52.

Transmitter 4 generates a predetermined signal which is in turn radiated and wirelessly transmitted to receiver 30. In a preferred embodiment, the output of transmitter 4 is coupled to wire means 22, which serves as a transmit antenna. Retractable wire 22 can be a suitable length of wire, cable, or any other electrically conductive material.

Figure 9:
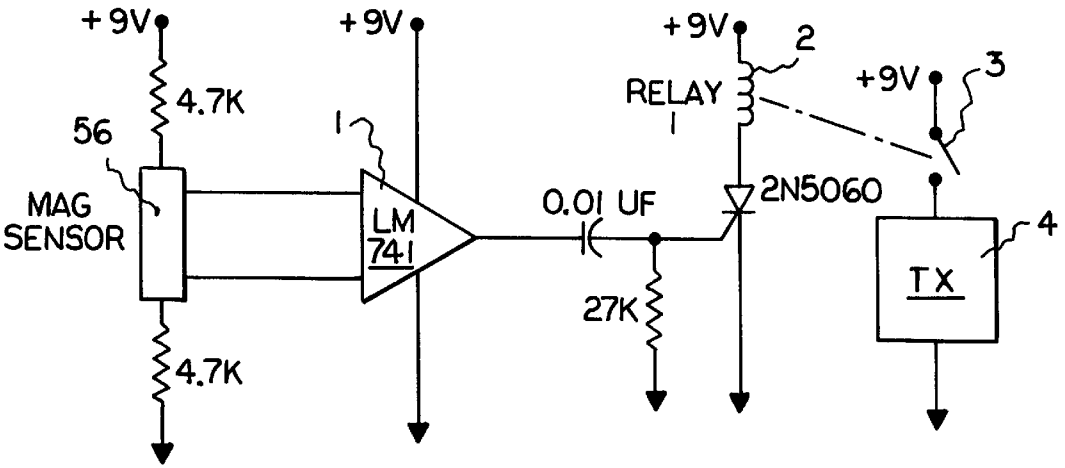
FIG. 9 is a schematic diagram of one embodiment of a transmitting means according to the present invention.

As will be readily appreciated by those skilled in the art, electronic circuit board 52, as embodied in the circuit diagram of FIG. 9 has many equivalents. It is not intended that the invention be limited to the particular circuit depicted in FIG. 9.

Returning now to FIGS. 7 and 8 electronic circuit board 52 may also include a lamp 32 which illustrates when switch 33 is turned to the "on" position and power from battery 44 is applied to the electronic components residing on circuit board 52. Electronic circuit board 52 is adapted to include openings 47 through which fastening means 43, which may be conventional screws, are passed as shown.

Rotatable frame 62, including retractable wire channel 64 and magnet means 54 is located beneath electronic circuit board 52. Rotatable frame 62 includes a central opening 70' through which central fastening means 60 is passed. Beneath rotatable frame 62 lies supporting base means 34 which is adapted to include a central threaded opening 72' for receiving the threaded end of central fastening means 60. Threaded nuts 42 receive fastening means 43, and act as spacers to hold rotatable frame 62 sufficiently distant from supporting base means 34 to allow rotatable frame 62 to rotate. In this manner circuit board 52, rotatable frame 62, and supporting base means 34 are coupled together such that rotatable frame 62 may rotate freely about central fastening means 60.

FIG. 8 shows spring means 58 as it appears coiled around the interior of rotatable frame 62. Spring means 58 is secured at one end to supporting base means 34 by means of pin 48. Spring means 58 is thereby positioned to maintain tension on retractable wire means 22, as rotatable frame 62 rotates. Thus spring means 58 provides the retraction mechanism for retractable wire means 22.

In accordance with the portability aspect of the present invention, the above-described structure has been modified as follows. First of all, rear panel 66 of casing 31 (FIGS. 3 and 8) has pressure-sensitive adhesive strips 70 thereon which can be pressed into firm engagement with a window-sill or door jamb (FIG. 1) and which will leave no marks when removed. Strips 70 are marketed under the trademark COMMAND of the 3M Company. The 3M COMMAND strips 70 have pressure-sensitive adhesive on both surfaces. One surface adheres to rear panel 66 and the other surface adheres to the fixed surface proximate the object whose movement is to be detected. Tabs 80 of strips 70 extend outwardly beyond panel 66 and they do not have any adhesive on their opposite sides. After the panel 66 has been adhesively secured to a surface and it is desired to demount the movement detecting and signal transmitting means 20, it is merely necessary to grasp each tab 80 and pull it away from panel 66 in the direction of the longitudinal axis of each strip and substantially parallel to the surface of panel 66. This will release the strips 70 from the surface on which member 20 is mounted and it may also release them from panel 66. Strips 70 preferably are applied to the rear panel 66 every time the member 20 is to be mounted. Any other suitable pressure-sensitive adhesive may be used. The main objective is that the mounting causes the signal transmitting means 20 be firmly mounted in a manner such that it will not move while mounted but which permits it to be removed so that it can be transported to another location.

Figure 11:
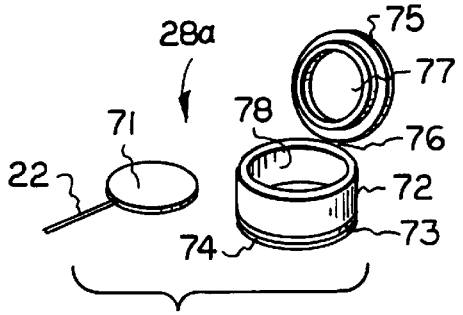
FIG. 11 is an exploded view of the structure for affixing the outer end of the retractable wire to the object whose movement is to be detected.

In accordance with the present invention, the retractable wire-affixing means 28*a* of FIG. 11 includes a disc 71 affixed to the outer end of wire 22 and an anchor member in the form of cup member 72 having pressure-sensitive adhesive 73 mounted on its underside which is covered by release paper 74. Cup member 72 also includes a cover 75 which is connected to cup member 72 by a molded hinge 76. The cover has a disc-like protrusion 77 having an outer edge which fits in tight engagement with the inner wall 78 of cup-like member 72 when the cover is in a closed position. The cup member 72 is a commercial product sold under the trademark CROWN BOLT of the Crown Bolt, Inc. company of Corritos, Calif., except that it does not have the pressure-sensitive adhesive thereon, which has been added in accordance with the present invention. It will be appreciated that other types of anchor members can be used instead of a cup member 72. Such devices may include a small hook or post mounted on a base having pressure-sensitive adhesive thereon in an analogous manner similar to adhesive 73. Also, as an alternative, disc 28 may have a hole therein so that it is essentially a ring which may be mounted on a simple post having a base with pressure-sensitive adhesive thereon, as noted above. Also, the post may have a bulbous outer end so that it looks like a collar button. Also, if desired, the outer end of wire 22 may be formed in a loop which may be placed on a post or hook. In fact, any suitable arrangement can be used wherein a small unobtrusive member, such as the foregoing anchor members, may be securely fastened to the member whose movement is to be detected and an attachment member may be formed on the end of the wire 22 which can be removably fastened to the small unobtrusive member.

In use, the cup anchor member 72 is securely adhesively affixed to an object whose movement is to be detected, such as a window or door, as shown by wire-affixing means 28 of FIG. 1, after the release paper 74 has been removed from pressure-sensitive adhesive 73. Thereafter, while the cover 75 is in the position shown in FIG. 11, the disc 71 at the end of wire 22 is inserted into the cavity of cup 72 and the lid 75 is closed. The other types of anchor members can be used as alternates to the cup anchor member. Thus, the system is in a position to operate as described above.

When the person who has temporarily used the portable system desires to leave the place where the system has been installed and take the portable system with him, he need merely deactivate the system and thereafter open lid 75 to remove disc 71 and permit wire 22 to retract disc 71 back to a position wherein it abuts the casing 31. The cylindrical cup 72 is merely left in position on the window or door jamb, and it is substantially unobtrusive inasmuch as its overall diameter is only about ⅜" and its height is about ¼". The other types of anchor members described above may also be left where they were adhesively secured to the movable member.

As noted above, the system of the present invention can be carried in a brief case, purse or overnight case from place to place. In this respect, the total weight of a preferred embodiment is approximately 20 ounces, and it has a volume which occupies a very small portion of a brief case, suitably sized purse or a suitcase.

While the foregoing portion of the specification has designated wire 22 as being an antenna, it will be appreciated that a suitable antenna may be incorporated within housing 31 and the element 22 may be a suitable high strength string-like member made of suitable plastic or any other suitable material.

While the invention has been described in conjunction with various embodiments, they are illustrative only. Accordingly, many alternatives, modifications and variations will be apparent to persons skilled in the art in light of the foregoing detailed description. The foregoing description is intended to embrace all such alternatives and variations falling with the spirit and broad scope of the appended claims.

What is claimed is:

1. A temporarily installed security alarm system for detecting the movement of a movable object comprising a movable object whose movement is to be detected, an anchor member for attachment to said movable object, movable magnet means, detecting and signal providing means for detecting movement of said movable magnet means and providing a signal in response to said movement, means for selectively temporarily adhesively securing said movement detecting and signal providing means to an immovable object, said detecting and signal providing means being in communication with said movable magnet means, coupling means for selectively temporarily coupling said movable magnet means to said anchor member on said movable object such that movement of said movable object results in movement of said movable magnet means, said coupling means having an adjustable length and having one end operatively connected to said movable magnet means and having another end provided with means for attachment to said anchor member, radiating means for wirelessly transmitting a predetermined signal in response to said signal, said radiating means being coupled to said detecting and signal providing means, and means for receiving said predetermined signal, said means for receiving being separate from and located at a distance from said radiating means.

2. The system of claim 1 wherein said movable magnet means is coupled to said object by a wire means.

3. The system of claim 2 wherein said wire means operates as said radiating means for wireless transmission of said predetermined signal.

4. The system of claim 2 wherein said wire means is retractable such that constant tension is applied to said wire means regardless of the direction of movement of said object.

5. The system of claim 1 wherein said means for receiving said wireless transmission of said predetermined signal includes means for generating an alarm signal when said predetermined signal is received.

6. The system of claim 5 wherein said alarm signal is an audible alarm signal.

7. The system of claim 5 wherein said alarm signal is a visual alarm signal.

8. The system of claim 5 wherein said alarm signal is an electronic alarm signal.

9. The system of claim 5 wherein said predetermined signal is a radio frequency signal.

10. The system of claim 5 further including remote control means.

11. The system of claim 10 wherein said means for receiving includes means for receiving a signal from said remote control means.

12. The system of claim 11 wherein said remote control means includes means for disabling said means for generating an alarm signal when said wireless transmission of said predetermined signal is received.

13. The system of claim 11 wherein said remote control means includes means for initiating said alarm signal in the absence of said predetermined signal.

14. A system for detecting the movement of an object comprising an object whose movement is to be detected, movable magnet means, means for detecting movement of said movable magnet means and providing an indication of said movement, said means for detecting being in communication with said movable magnet means, means for coupling said movable magnet means to said object such that movement of said object results in movement of said movable magnet means, said means for coupling having an adjustable length and having one end operatively connected to said movable magnet means and having another end provided with means for affixing said means for coupling to said object at selected locations thereon, radiating means for wirelessly transmitting a predetermined signal in response to said indication, said radiating means being coupled to said means for detecting, and means for receiving said predetermined signal, said means for receiving being separate from and located at a distance from said radiating means, said movable magnet means being coupled to said object by a wire means, and said wire means operating as said radiating means for wireless transmission of said predetermined signal.

15. The system of claim 14 wherein said wire means is retractable such that constant tension is applied to said wire means regardless of the direction of movement of said object.

16. The system of claim 14 wherein said means for receiving said wireless transmission of said predetermined signal includes means for generating an alarm signal when said predetermined signal is received.

17. A system for detecting the movement of an object comprising an object whose movement is to be detected, movable magnet means coupled to said object such that movement of said object results in movement of said movable magnet means, means for detecting movement of said movable magnet means and providing an indication of said movement, said means for detecting being in communication with said movable magnet means, radiating means for wirelessly transmitting a predetermined signal in response to said indication, said radiating means being coupled to said means for detecting, means for receiving said predetermined signal, said means for receiving being separate from and located at a distance from said radiating means, and said movable magnet means being coupled to said object by a wire means and said wire means operating as said radiating means for wireless transmission of said predetermined signal.

18. A method of temporarily installing a security alarm system comprising the steps of adhesively securing an anchor member to a movable object whose motion is to be detected, removably adhesively mounting a motion detecting and signal radiating member to an immovable object proximate said movable object, temporarily coupling said motion detecting and signal radiating member to said anchor member on said movable object, temporarily installing a signal receiving and alarm generating member remote from said motion detecting and signal transmitting member, decoupling said motion detecting and signal radiating member from said anchor member, and demounting said motion detecting and signal radiating member from said immovable object.

19. A method as set forth in claim 18 including the step of permitting said anchor member to remain adhesively secured to said movable object after said motion detecting and signal radiating member has been decoupled from said anchor member and said motion detecting and signal radiating member has been demounted.

20. A temporarily installed security alarm system comprising an anchor member for attachment to a movable object whose motion is to be detected, a motion detecting and signal radiating member separate from said anchor member and having adhesive thereon for temporarily adhesively securing said motion detecting and signal radiating member on an immovable object, coupling means for temporarily coupling said motion detecting and signal radiating member to said anchor member, and a signal receiving and alarm generating member temporarily positioned remote from said motion detecting and signal radiating member, said anchor member being permanently attached to said movable object.

21. A temporarily installed security alarm system comprising an anchor member for attachment to a movable object whose motion is to be detected, a motion detecting and signal radiating member separate from said anchor member and having adhesive thereon for temporarily adhesively securing said motion detecting and signal radiating member on an immovable object, coupling means for temporarily coupling said motion detecting and signal radiating member to said anchor member, and a signal receiving and alarm generating member temporarily positioned remote from said motion detecting and signal radiating member, said coupling means comprising a retractable wire mounted on said motion detecting and signal radiating member.

22. A temporarily installed security alarm system comprising an anchor member for attachment to a movable object whose motion is to be detected, a motion detecting and signal radiating member separate from said anchor member and having adhesive thereon for temporarily adhesively securing said motion detecting and signal radiating member on an immovable object, coupling means for temporarily coupling said motion detecting and signal radiating member to said anchor member, and a signal receiving and alarm generating member temporarily positioned remote from said motion detecting and signal radiating member, said anchor member being a cup member having pressure sensitive adhesive thereon.

23. A temporarily installed security alarm system as set forth in claim 22 including a cover on said cup member.

24. A temporarily installed security alarm system as set forth in claim 23 wherein said coupling means comprises a disc mounted at the end of a retractable member.

25. A temporarily installed security alarm system comprising an anchor member for attachment to a movable object whose motion is to be detected, a motion detecting and signal radiating member separate from said anchor member and having adhesive thereon for temporarily adhesively securing said motion detecting and signal radiating member on an immovable object, coupling means for temporarily coupling said motion detecting and signal radiating member to said anchor member, and a signal receiving and alarm generating member temporarily positioned remote from said motion detecting and signal radiating member, said coupling means comprising a retractable member mounted on said motion detecting and signal radiating member.

26. A temporarily installed security alarm system as set forth in claim 25 including a remote control for selectively enabling and disabling said signal receiving and alarm generating member.

* * * * *